United States Patent [19]

Reed

[11] 4,171,187

[45] Oct. 16, 1979

[54] AIR INJECTION SUB

[75] Inventor: Thomas C. Reed, Wichita Falls, Tex.

[73] Assignee: Walker-Neer Manufacturing Co., Inc., Wichita Falls, Tex.

[21] Appl. No.: 819,713

[22] Filed: Jul. 28, 1977

[51] Int. Cl.[2] ..... F04F 5/46; E21B 21/00

[52] U.S. Cl. ..... 417/170; 175/213; 175/215; 417/108; 175/324

[58] Field of Search ..... 175/215, 320, 324, 213, 175/100; 166/242; 417/108, 109, 110, 111, 115, 197, 198, 170, 172; 173/60; 137/155

[56] References Cited

U.S. PATENT DOCUMENTS

| | | | |
|---|---|---|---|
| 302,182 | 7/1884 | Zotoff | 417/170 |
| 1,071,199 | 8/1913 | Andrews | 175/324 |
| 1,209,505 | 12/1916 | Sinclair | 417/172 X |
| 3,672,790 | 6/1972 | White et al. | 417/108 |
| 3,795,283 | 3/1974 | Oughton | 175/215 |
| 3,807,514 | 4/1974 | Murrell | 175/215 |
| 3,978,923 | 9/1976 | Ford | 175/215 |

*Primary Examiner*—Ernest R. Purser
*Attorney, Agent, or Firm*—Hume, Clement, Brinks, Willian & Olds, Ltd.

[57] ABSTRACT

An air injection sub for use with a dual conduit drill pipe string is provided having inner and outer concentric tubular members which are connected to the corresponding inner and outer conduits of a dual conduit string to provide isolated annular and central passageways and is particularly characterized by improved injection means in the inner tubular member which allows fluid to pass from the annular passageway into the central passageway through a plurality of apertures which open into the central passageway at a plurality of levels and angular positions, is field adjustable and provides improved erosion resistance.

14 Claims, 5 Drawing Figures

FIG. 1
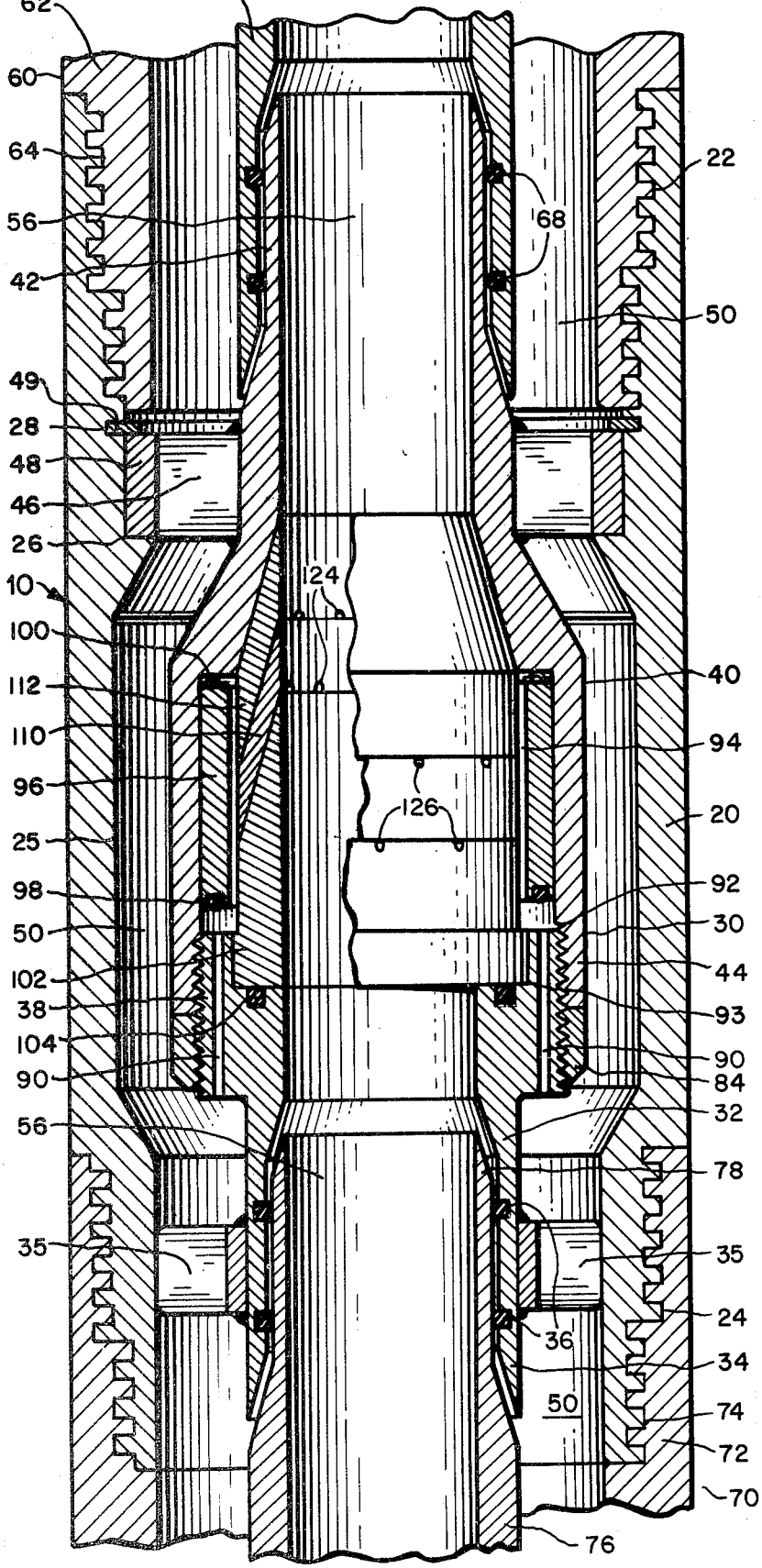
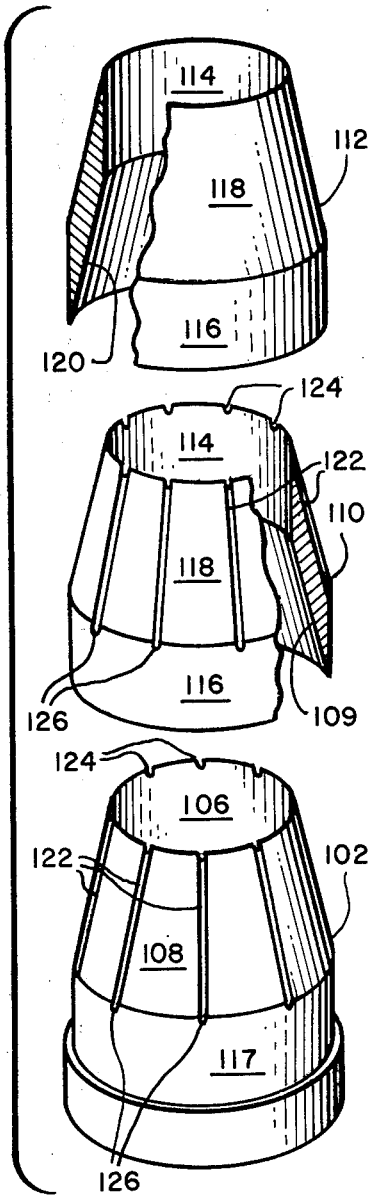
FIG. 3

AIR INJECTION SUB

BACKGROUND OF THE INVENTION

This invention concerns an injection sub for use with dual conduit drill pipe systems and more particularly a field adjustable air diffusion sub having improved injection characteristics.

In dual conduit drill pipe systems the individual segments of the drill pipe string include an inner conduit which is disposed concentrically within an outer conduit. When the segments are joined together, two isolated passageways are defined which extend from one end of the string to the other: the interior of the inner conduit (the central passageway) and the space between the inner and outer conduits (the annular passageway). Air lift techniques may be advantageously used with such dual conduit pipe by pumping drilling fluid and compressed air down the annular passageway. The cuttings from the drill bit and drilling fluid then pass through the drill bit and up to the surface through the inner conduit. It has been found that compressed air injected into the inner conduit assists in lifting the cuttings to the surface.

As disclosed in U.S. Pat. No. 3,978,923 issued to George A. Ford, injection subs have been used to diffuse air from the annular passageway into the inner conduit at preselected points along the drill pipe string. Injection subs such as that disclosed by Ford, while improving the lift characteristics of the dual conduit system, have suffered from certain limitations. Such injection subs introduced air into the inner conduit through a circular array of apertures. Such a circular array has a maximum number of apertures limited to the number that can be placed along one circumference of the inner passageway. It has been found that the use of a large number of small injection apertures reduces the turbulence induced in the inner conduit and results in a more efficient air lift system. Prior art injector subs were limited to a single linear array of apertures and consequently could not realize the full lift potential of the injector sub. Secondly, such prior art injection subs were not field adjustable. The rate of air injection was determined by the size and spacing of apertures formed in one of the major structural elements of the injector sub, and the injection rate could not be altered without replacing this entire element. Thirdly, these injection subs were subject to erosion damage to the major structural elements of the sub. During drill bit operation the drilling fluid contained in the inner passageway is an abrasive slurry of suspended cuttings. Eddies are produced in this abrasive slurry by the injection of air into the inner passageway, and these eddies result in increased erosion of the walls of the inner passageway adjacent to the injection apertures. In the case of prior art injection subs, the injection apertures were formed in major structural elements, and erosion damage near the apertures could require the replacement of the entire element.

SUMMARY OF THE INVENTION

The present invention contemplates an improved injection sub which provides improved air injection characteristics and is field adjustable. These objects are achieved by providing an injection sub with inner and outer concentric tubular members which are connected to the corresponding conduits of a dual conduit drill pipe string. An injection means is provided in the inner tubular member to allow fluid to pass from the annular passageway into the central passageway through a plurality of apertures of levels and angular positions. By providing injection apertures at several levels a larger number of apertures may be utilized, resulting in improved lift characteristics. In one embodiment of the present invention, the injection apertures are formed in erosion resistant injector rings which are detachably mounted in the inner tubular member. An erosion resistant shield ring is provided between the uppermost injector ring and the inner tubular member in order to protect the inner surface of this member from erosion. This injection sub is field adjustable in that the inner tubular member may be disassembled and injector rings having apertures of the desired number and size inserted prior to reassembly of the injector sub. Furthermore, erosion damage to the injection apertures of this sub may be remedied by replacing eroded rings with new injector and shield rings.

BRIEF DESCRIPTION OF THE DRAWINGS

The novel features which are believed to be characteristic of the invention are set forth in the appended claims. The invention itself, together with further objects and attendant advantages will be best understood by reference to the following description taken in connection with the accompanying drawings, in which:

FIG. 1 is a transverse sectional view of an injection sub embodying the present invention;

FIG. 3 is an exploded perspective view of the annular injector and shield rings of the injection sub of FIG. 1;

DETAILED DESCRIPTION

Figure 2:
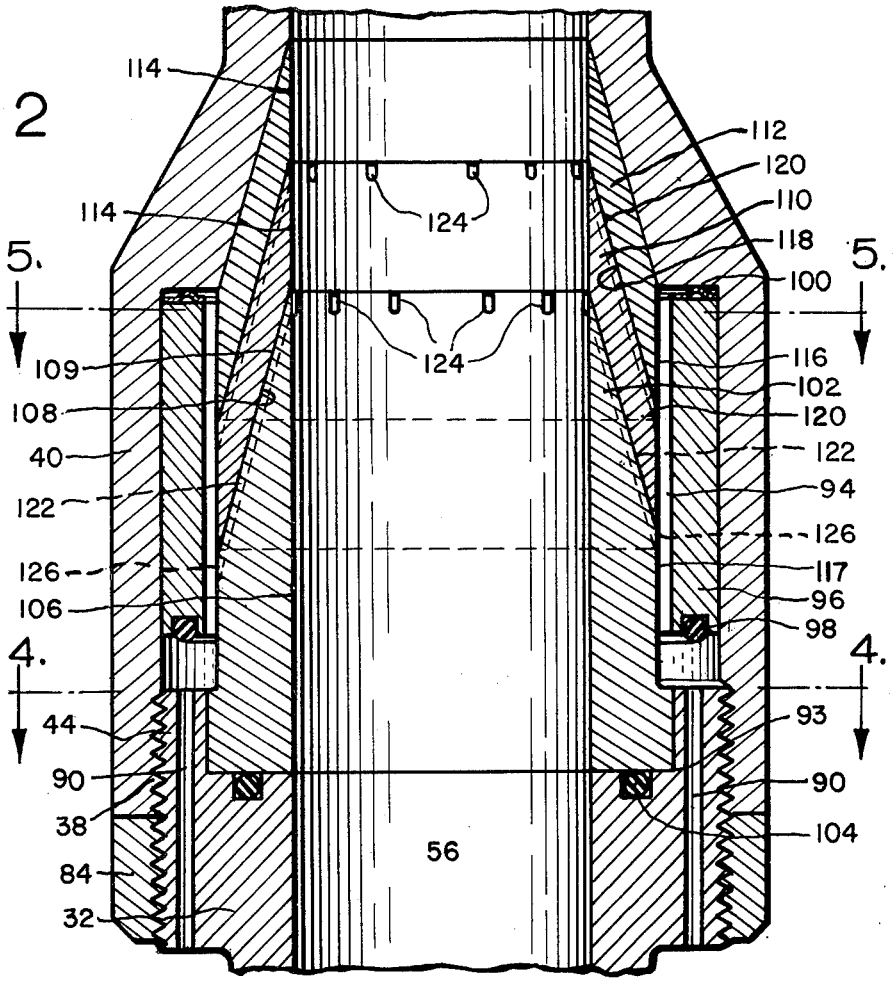
FIG. 2 is a fragmentary sectional view of a portion of the injection sub depicted in FIG. 1.
Figure 4:
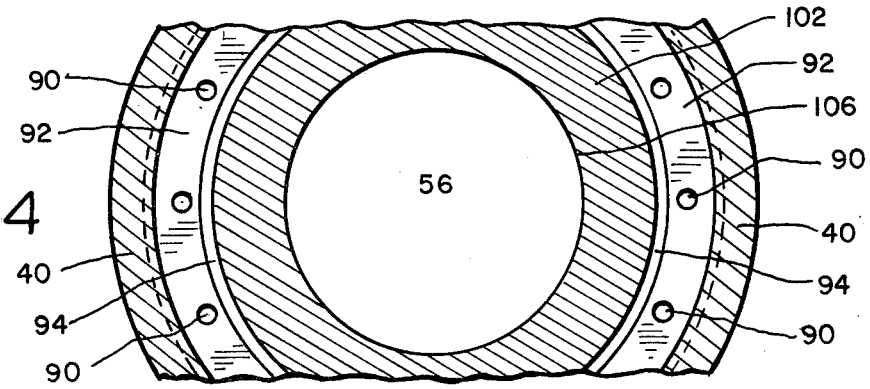
FIG. 4 is a fragmentary cross sectional view taken along line 4—4 of FIG. 2.
Figure 5:
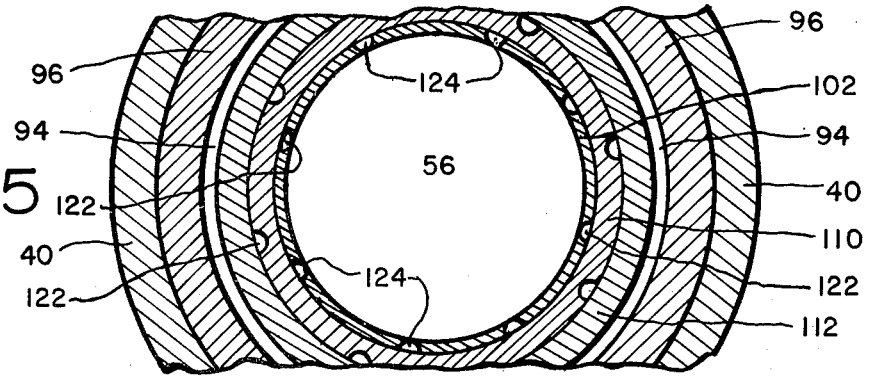
FIG. 5 is a fragmentary cross sectional view taken along line 5—5 of FIG. 2.

With reference to the drawings, there is shown in FIG. 1, as an example of the preferred embodiment of the present invention, an injection sub generally indicated by the reference numeral 10. This injection sub 10 will be described first in terms of its major structural elements and then in terms of its functional elements which cooperate to perform the air injection.

The main structural element of the injector sub 10 is the outer tubular member 20 which is threaded at both the upper end 22 and the lower end 24 for engaging the injector sub 10 with two adjacent segments 60 and 70 of the dual conduit drill pipe string. The details of this interconnection will be discussed below. The inner tubular member 30 is disposed inside the outer tubular member 20 and is structurally comprised of an injector housing 32 and a check valve housing 40 which are secured together by mating threads in the upper end 38 of the injector housing 32 and the lower end 44 of the check valve housing 40. The check valve housing 40 is provided with an upper end 42 which engages the inner conduit 66 of the upper adjacent drill string segment 60. The anchor ring 48 is attached to the check valve housing 40 by means of spacer lugs 46. The injector housing 32 is provided with a lower end 34 to which spacer lugs 35 are attached. O ring seals 36 are mounted on the interior surface of the lower end 34 of the injector housing 32 and serve to engage the inner conduit 76 of the lower adjacent drill string segment 70.

The injector sub 10 is assembled by inserting the inner member 30 in the outer member 20 until the anchor ring 48 comes into contact with the mating seating shoulder 26 of the outer member 20. Retaining ring 49 is then installed in groove 28 of outer member 20 in order to hold the anchor ring 48 firmly in place against the seating shoulder 26. When assembled, the anchor ring 48 and attached spacer lugs 46 concentrically position the check valve housing 40 within the outer member 20 and the spacer lugs 35 concentrically position the injector housing 32. An annular fluid passageway 50 is formed between the outer member 20 and the inner member 30. The two sets of spacer lugs 35 and 46 occupy a small part of the cross sectional area of this annular passageway 50, and do not substantially impede the free flow of fluid through the annular passageway 50. A cylindrical central passageway 56 is defined by the inner wall of the inner member 30.

The injector sub 10 is installed in the drill pipe string by engaging the upper and lower threads 22 and 24 of the outer tubular member 20 to the corresponding threads 64 and 74 of the outer conduits 62 and 72 of the upper and lower adjacent drill pipe string segments 60 and 70. As the upper segment 60 is being threaded onto the injector sub 10, the inner conduit 66 slides over the upper end 42 of the check valve housing 40. O ring seals 68 are mounted inside the inner conduit 66 to provide a fluid tight seal between the inner conduit 66 and the check valve housing 40. Similarly, when the injector sub 10 is threaded onto the lower segment 70, the lower end 34 of the injector housing 32 slides over the tapered end 78 of the inner conduit 76 and O ring seals 36 provide a fluid tight seal. When the injector sub 10 is installed in the drill pipe string, continuous, isolated annular and central passageways 50 and 56 are maintained from the upper segment 60, through the injector sub 10, to the lower segment 70.

Referring now to FIGS. 2 and 3, the internal elements of the inner tubular member 30 cooperate to permit fluid to pass from the annular passageway 50 to the central passageway 56, while substantially preventing reverse fluid flow from the central 56 to the annular 50 passageway. The injector housing 32 is provided with a circular array of ports 90 which serve to pass fluid from the annular passageway 50 into the annular chamber 94. Three annular rings, 102, 110, and 112, are mounted on the injector housing 32 and form the inside surface of the annular chamber 94. The base injector ring 102 is placed in recess 93 of the injector housing 32. O ring seal 104 provides a fluid tight seal between the mating surfaces. The second injector ring 110 and the shield ring 112 are stacked on top of the base injector ring 102 and, in the assembled injection sub, are held in place by the check valve housing 40. FIG. 3 provides an exploded perspective view of the three rings 102, 110, and 112. The base injector ring 102 is provided with a sloping upper transverse surface 108 into which grooves 122 are formed. These grooves extend along the transverse surface 108 from the inner cylindrical surface 106 to the outer cylindrical surface 117. The second injector ring 110 is provided with upper and lower sloping transverse surfaces 118 and 109, respectively. The upper transverse surface 118 defines grooves 122 extending from the inner cylindrical surface 114 to the outer cylindrical surface 116 of the second injector ring 110. As shown in FIG. 2 the lower transverse surface 109 of the second injector ring 110 is sloped at the same angle as the upper transverse surface 108 of the base injector ring 102 and is not grooved. The shield ring 112 is configured similarly to the second injector ring 110, having inner and outer cylindrical surfaces, 114 and 116, and upper and lower sloped transverse surfaces, 118 and 120, respectively; however, the shield ring 112 is not provided with grooves 122.

When the three rings are stacked in their assembled position, the lower transverse surface 109 of the second injector ring 110 provides a top surface to the grooves 122 of the base injector ring 102. Similarly, the lower transverse surface 120 of the shield ring 112 provides a top surface to the grooves 122 of the second injector ring 110. Thus, when the three rings are assembled, the grooves 122 serve as apertures opening at one end 126 into the annular chamber 94 and at the other end 124 into the central passageway 56. These apertures serve to pass fluid from the annular chamber into the central passageway. In the preferred embodiment, the grooves 122 are angled upwardly, and each groove 122 lies in a separate plane which passes through the centerline of the central passageway. This groove arrangement minimizes the rotation induced in the fluid of the central passageway by the air injection, and is thought to result in improved lift characteristics for the injection sub.

During operation of the drill bit, the central passageway normally contains an abrasive slurry of cuttings suspended in drilling fluid. The air which is injected through the grooves 122 into the central passageway tends to induce eddy currents in this slurry, and these eddy currents tend to erode the perimeter of the central passageway adjacent to the openings 124 through which air is injected. This erosion results in enlargement of the openings 124 as well as pitting of the perimeter of the central passageway. In order to reduce the rate of erosion the three rings 102, 110, and 112 should be made from a relatively hard, erosion resistant material. The shield ring 112 serves to protect the check valve housing 40 from erosion and consequently the check valve housing 40 may be made of a less erosion resistant material than would otherwise be desirable.

The outside perimeter of the annular chamber 94 is defined by the check valve housing 40. The array of ports 90 in the injector housing 32 passes fluid from the annular passageway 50 into the annular chamber 94, and the grooves 122 pass fluid from the annular chamber 94 to the central passageway 56. Annular check valve 96 is provided with an O ring seal 98 and is free to slide between a lower position, not shown, in which the O ring seal 98 seals the array of ports 90 closed and an upper position, as shown in FIG. 2, which allows fluid to flow through the ports 90 into the annular chamber 94. Check valve spring 100 is provided at the top of the check valve 96 to prevent the check valve 96 from sticking in its upper position. When the fluid pressure in the annular passageway 50 is sufficiently greater than that of the annular chamber 94 the positive differential pressure raises the check valve 96 and opens the ports 90. Conversely, when the differential pressure is low or negative the force of gravity assisted by the check valve spring 100 lowers the check valve, sealing off the ports 90 and thereby impeding the flow of fluid from the annular chamber 94 to the annular passageway 50.

When the inner tubular member 30 is fully assembled, the injector housing 32 is firmly attached to the check valve housing 40, as by threads 38 and 44 which are secured by a lock unit 84. One advantage of the improved injector sub of this invention is that it may be readily disassembled for field adjustment. The rate at which fluid from the annular passageway 50 is injected into the central passageway 56 is determined in part by the number and the size of the grooves 122 in the injector rings 102 and 110. The rate of fluid injection can therefore be adjusted by placing injector rings with the desired combination of groove size and number in the injector sub. The injector sub 10 may be field adjusted by first removing the inner tubular member 30 from the outer tubular member 20 as described above. Then the lock nut 84 and the check valve housing 40 are removed from the injector housing 32. The injector rings 102 and 110 are then removed and replaced with injector rings having the desired aperture size and spacing. The shield ring 112 is normally left in place, as it serves to protect the inner surface of the check valve housing 40. Finally, the check valve housing 40 and lock nut 84 are replaced on the injector housing 32 and the assembled inner member 30 is reinserted in the outer member 20. A further advantage of the modular construction of the present invention is that erosion damage to the injection apertures can be remedied in the field by disassembling the sub and replacing the eroded rings with new rings having properly sized apertures.

A second advantage of this injector sub is that fluid is injected into the central passageway 56 at a number of levels. In the preferred embodiment described here, fluid is injected at two levels; however alternate embodiments of the present invention could incorporate injection at three or more levels. Injecting fluid through apertures 122 at two or more levels permits the use of a greater number of smaller apertures than would otherwise be possible, thereby improving the lifting capability of the injector sub. More uniform lifting capability around the perimeter of the central passageway is provided by orienting the apertures at the various levels in such a way that at each level no aperture is directly above any aperture at a lower level. Although a wide range of sizes and spacings of the ports 90 and the apertures 122 is permissable, it has been found that excellent results may be obtained in an injection sub having a central passageway two and three quarters of an inch in diameter by making the ports 90 one-eighth of an inch in diameter with a center to center spacing of three-eighths inch, and the openings 124 measuring one-sixteenth of an inch on each side with a center to center spacing of approximately one inch.

Of course, it should be understood that various changes and modifications to the preferred embodiments described herein will be apparent to those skilled in the art. Such changes and modifications can be made without departing from the spirit and scope of the present invention. It is, therefore, intended that such changes and modifications be covered by the following claims.

I claim:

1. An injection sub for use in a dual conduit drill pipe string including concentric inner and outer conduits comprising:

an outer tubular member adapted for engagement with adjacent upper and lower outer conduits of said string;

an inner tubular member disposed concentrically within said outer member, said inner and outer members defining an annular passageway therebetween and the interior surface of said inner member defining a central passageway;

injection means disposed within said inner member for passing fluid from said annular passageway, through the inner tubular member, to said central passageway; and a plurality of coaxially stacked ring members included in the injection means, said ring members removably mounted in the inner member and defining a plurality of apertures for passing fluid into the central passageway.

2. The injection sub defined in claim 1 further defined in that one of said ring members is placed to protect a portion of said inner member from erosion associated with the injection of fluid into said central passageway through said injection means.

3. The injection sub defined in claim 1 wherein said plurality of apertures is oriented to direct fluid into said central passageway upwardly along a plurality of lines which pass through the centerline of said central passageway.

4. An injection sub for use with a dual conduit drill pipe string having concentric inner and outer conduits comprising:

an outer tubular member;

an inner tubular member disposed concentrically within said outer member, said outer and inner members defining an annular fluid passageway therebetween and said inner member defining a central passageway;

injector means mounted on the inner tubular member for passing fluid from the annular passageway through the inner tubular member, into the central passageway;

a plurality of stacked, detachable members included in the injector means adjacent the central passageway, said members substantially defining a plurality of apertures oriented to pass fluid into the central passageway.

5. The injection sub disclosed in claim 4 wherein said plurality of apertures is oriented to direct said fluid into said central passageway upwardly along a plurality of lines which pass through the centerline of said central passageway.

6. An injection sub as defined in claim 4 wherein said plurality of apertures opens into said central passageway at a plurality of levels and angular positions.

7. An injection sub as defined in claim 4 further comprising a detachable erosion resistant annular ring disposed within said inner member adjacent said injection means, said erosion resistant ring adapted to protect a portion of said inner member from erosion associated with the injection of fluid into said central passageway through said injector means.

8. An injection sub as defined in claim 4 wherein said plurality of stacked detachable members includes a plurality of detachable stacked coaxial annular rings, each of said rings substantially defining a plurality of apertures adapted to pass fluid from said central chamber to said inner passageway.

9. An injection sub as defined in claim 8 wherein said annular rings are further defined in that each of said rings defines an inner surface, an outer surface, and two transverse surfaces, and further, that at least two mating transverse surfaces of said annular rings are sloped with respect to said inner and outer surfaces, said sloping transverse surfaces serving to co-axially position said rings when said injection means is assembled in said inner member.

10. An injection sub for use with a dual conduit drill pipe string having concentric inner and outer conduits comprising:

an outer tubular member adapted for engagement with adjacent upper and lower outer conduits of said string;

an inner tubular member disposed concentrically within said outer member, said inner and outer members defining an annular passageway therebetween and the interior of said inner member defining a central passageway;

injection means for passing fluid from the annular passageway through the inner member to the central passageway;

a plurality of stacked, coaxial annular rings included in the injection means and mounted within the inner member adjacent the central passageway, each of said rings defining an inner surface which forms a portion of the perimeter of the central passageway and two transverse surfaces, wherein at least two mating transverse surfaces are sloped with respect to the inner surface in order to coaxially position the rings when the rings are assembled in the inner member; and an array of apertures defined by said stacked rings and oriented to pass fluid through the rings into the central passageway.

11. The injection sub of claim 10 wherein at least a portion of the apertures are defined by grooves formed in one of the transverse surfaces of one of the rings.

12. The injection sub of claim 10 wherein one of the rings is positioned adjacent the inner member and is adapted to protect the inner member from erosion associated with the injection of fluid into the central passageway.

13. The injection sub of claim 10 wherein the plurality of apertures is oriented to direct fluid into the central passageway upwardly along a plurality of lines which pass through the centerline of the central passageway.

14. In an injection sub for use with dual conduit drill pipe, said sub including concentric tubular elements defining a central passageway and a concentric annular passageway, and injection means for passing fluid from the annular to the central passageway, the improvement comprising:

a plurality of detachable coaxially stacked annular injection rings included in the injection means, said rings defining apertures for injecting fluid into the central passageway, each of said rings defining an inner surface which forms a portion of the perimeter of the central passageway and two transverse surfaces, wherein at least two mating transverse surfaces are sloped with respect to the inner surface in order to coaxially position the rings when the rings are assembled in the injection sub.

* * * * *